United States Patent [19]

Glaus et al.

[11] Patent Number: 4,798,231

[45] Date of Patent: Jan. 17, 1989

[54] METHOD AND DEVICE FOR CONNECTING AT LEAST TWO RODS

[75] Inventors: Heinrich Glaus, Niederwangen; Peter Lehmann, Kirchdorf; Hans Joehr, Kehrsatz; René Freiburghaus, Bern, all of Switzerland

[73] Assignee: Styner & Bienz AG, Niederwangen, Switzerland

[21] Appl. No.: 67,740

[22] PCT Filed: Sep. 24, 1986

[86] PCT No.: PCT/CH86/00133

§ 371 Date: May 22, 1987

§ 102(e) Date: May 22, 1987

[87] PCT Pub. No.: WO87/01753

PCT Pub. Date: Mar. 26, 1987

[30] Foreign Application Priority Data

Sep. 24, 1985 [CH] Switzerland ..... 4115/85

[51] Int. Cl.[4] ..... B21F 15/04

[52] U.S. Cl. ..... 140/119; 140/57; 140/93 A

[58] Field of Search ..... 140/54, 57, 51, 93 A, 140/93.6, 119, 113, 115

[56] References Cited

U.S. PATENT DOCUMENTS 261,246 7/1882 Moses ..... 140/119
3,169,559 2/1965 Working .
3,810,495 5/1974 Pack .

FOREIGN PATENT DOCUMENTS 2458133 6/1976 Fed. Rep. of Germany .
3223090 12/1983 Fed. Rep. of Germany .
714652 11/1931 France .
943486 12/1963 United Kingdom .

*Primary Examiner*—Lowell A. Larson
*Attorney, Agent, or Firm*—Marks Murase & White

[57] ABSTRACT

In the method for connecting at least two rods, wherein a binding apparatus, which is provided with a rotatable hook member, seizes a wire loop, which extends around the rods, and twists the loop during a pulling movement. The wire clamp or clip which has leg portion ends provided with locking means is brought around the rods to be connected in such a manner that, when viewed from the hook member the locking means are brought into engagement with each other behind the rods, and the closed wire clamp in front of the rods is seized by the hook member of the binding apparatus and twisted.

The device required for this purpose includes a binding apparatus which has a slide member connected to a displaceable gripping member for the forward advancement of the wire clamp and closing jaws which are adapted to bring the locking members on the wire clamp into engagement behind the rods to be connected.

21 Claims, 12 Drawing Sheets

A
B
C
VI
VI

METHOD AND DEVICE FOR CONNECTING AT LEAST TWO RODS

The present invention relates to a method for connecting at least two rods, wherein an apparatus, which is provided with a rotatable grabbing means, seizes a wire loop, which extends around the rods, and twists the loop during a pulling movement, and to a device for accomplishing the method. Such a method and device are generally used for securing reinforcement steel rods during the production of reinforced concrete structures, the reinforcement steel rods usually lying one above the other in an orthogonal manner and being interconnected at their points of intersection.

A plurality of methods and devices are known for accomplishing the securement of these reinforcement rods, such work often being undertaken by specialists under contract. Since it is necessary to secure a very large number of intersection points, especially in the case of large-scale buildings, a number of apparatus which operate automatically or semi-automatically have been designed and patented, but none of these apparatus have yet been successful on the market, since they are usually too complex or become faulty with rough handling on a building site. For this reason, simple methods and apparatus still exist, which depend mainly on the skill and stamina of the specialist worker. In such a case, prefabricated wire loops are used which have rings or eyelets at their two ends. As a result of the required flexibility and, hence, minimum thickness of the wire, for safety reasons, two of these wire loops are manually placed around the particular rods to be connected, and the four wires of the loops at the top are seized by a twisting apparatus which comprises a rod with a hook, the rod being knurled and extending in a suitable handle so that, when the handle is pulled, the rod and, hence, the hook are set in rotation. This method and apparatus have the advantage of being simple, but the apparatus, which is only formed from two component parts, has the considerable disadvantage that the wire loops have to be inserted beneath the rods to be connected, so that the person carrying out the work has to bend down low if, as is generally the case, the reinforcement rods are on the ground. In addition, the wire loops have to be carried in one hand whilst the apparatus is operated with the other hand. In order to permit as many wire loops as possible to be seized at any one time, the connection points should not occur at the eylets and, as a consequence thereof, it is necessary to weld-on the eyelets instead of twisting them. This means that two wire loops with four welding points are required per working operation, and consequently the production of these wire loops becomes labour-intensive and, as a result, relatively costly.

By comparison, the present invention seeks to provide a method and a device for accomplishing the method, whereby it is easier and quicker for the operator to connect at least two rods, and whereby the material costs for a connection can be reduced. This object is achieved by the method and device described in the claims.

The invention is explained more fully hereinafter with reference to embodiments.

Figure 13A:
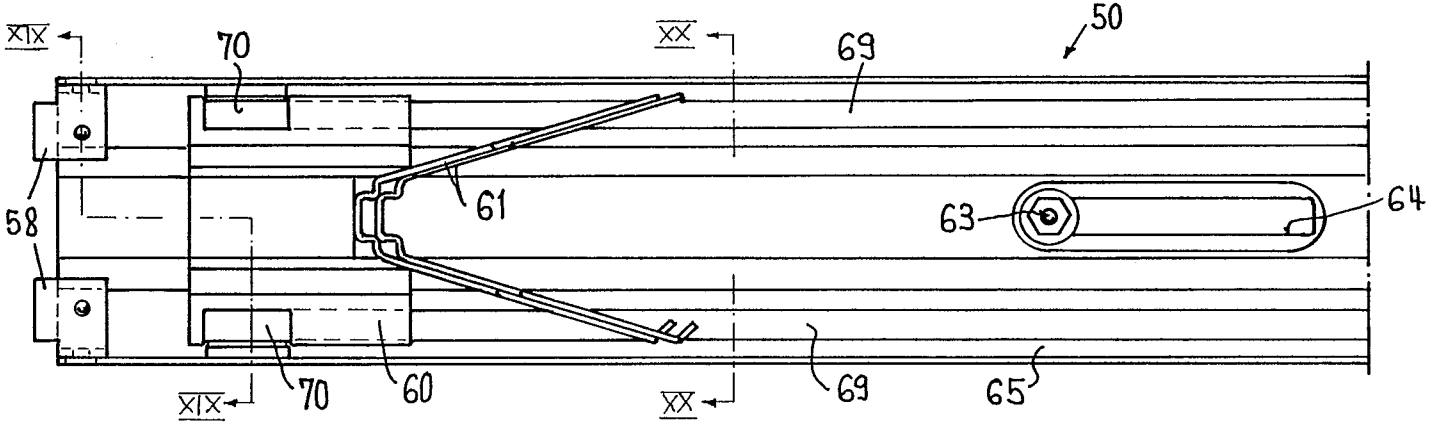
Figure 14A:
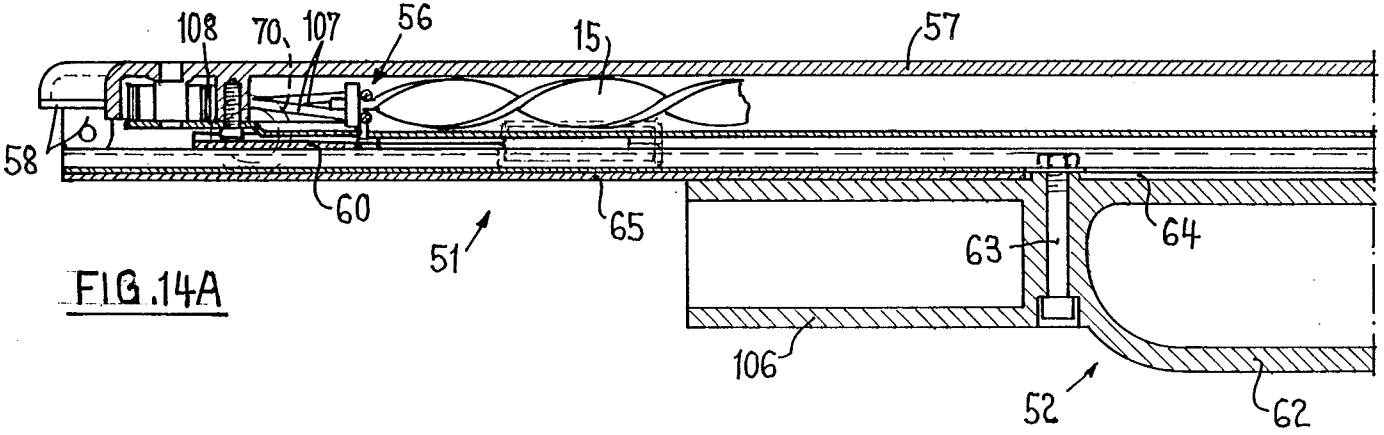
Figure 13B:
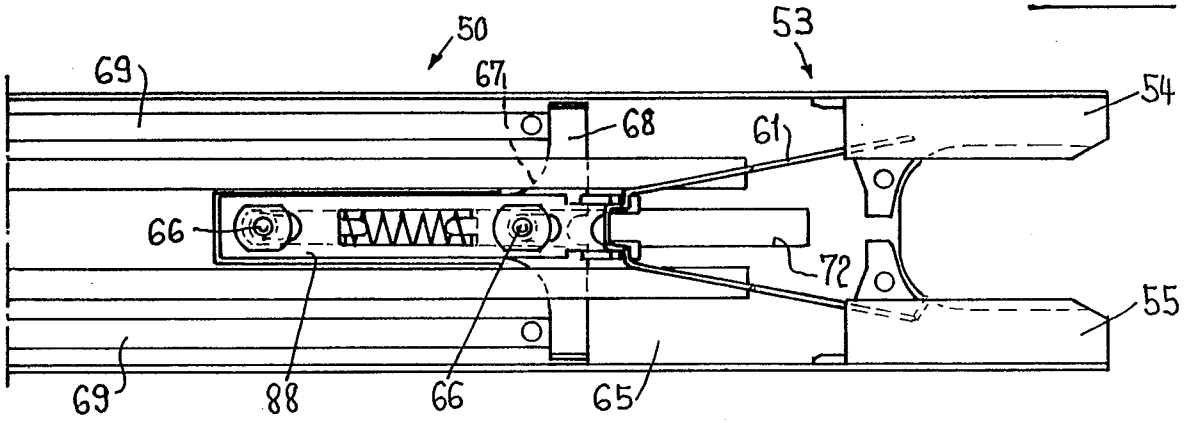
Figure 14B:
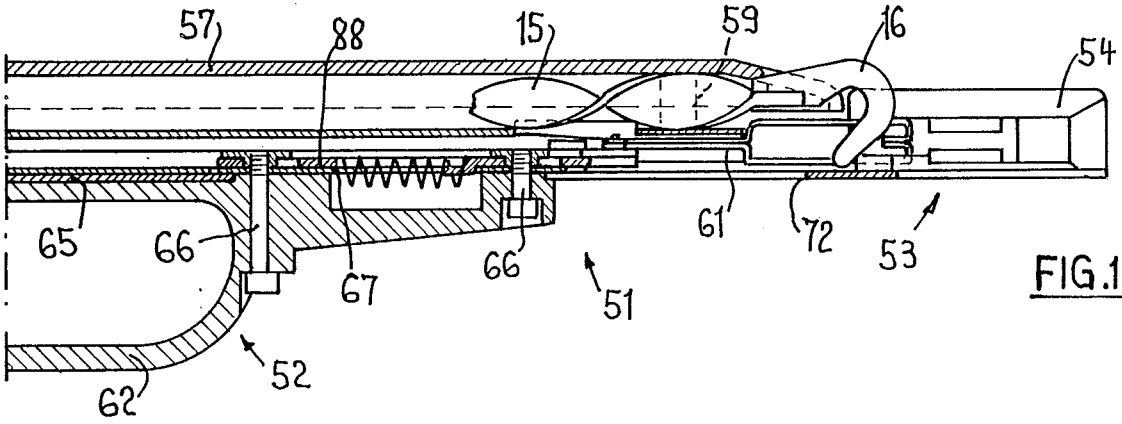

FIGS. 13*a* and 13*b* are plan views of a third, preferred, embodiment without a cover;

FIGS. 14*a* and 14*b* are longitudinal sectional views of FIGS. 13*a* and 13*b;*

Figure 15:
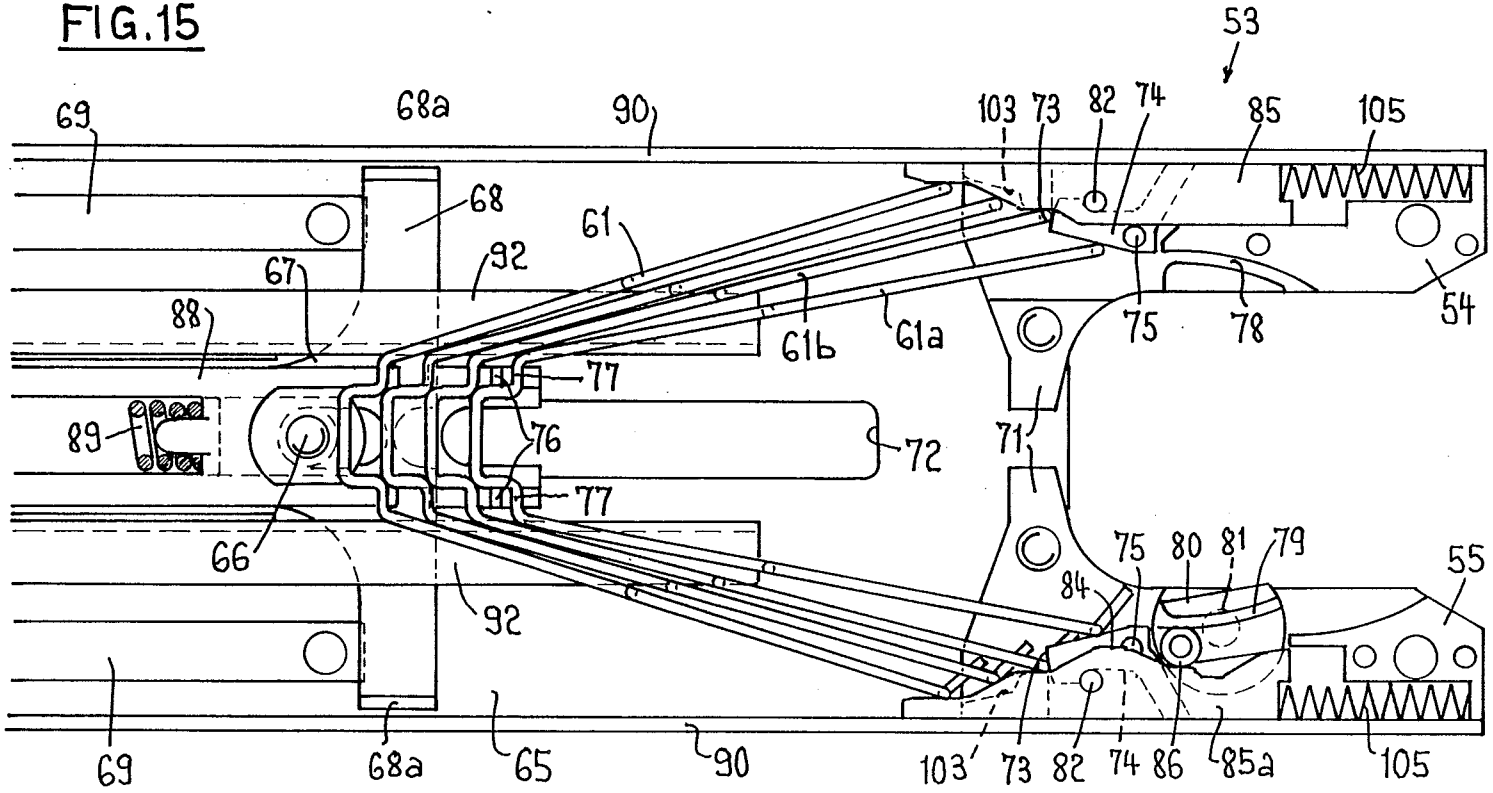
Figure 16:
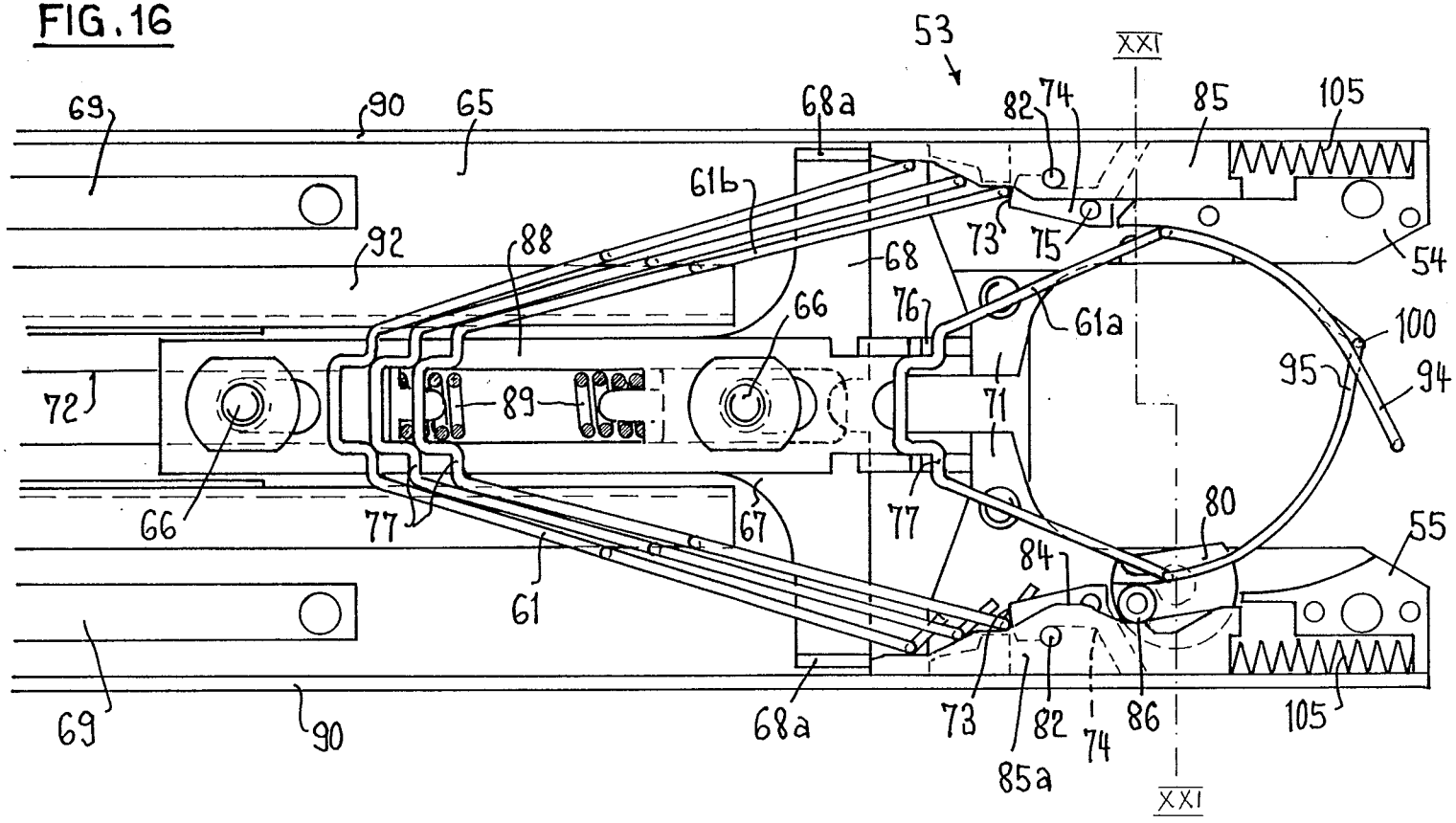
Figure 17:
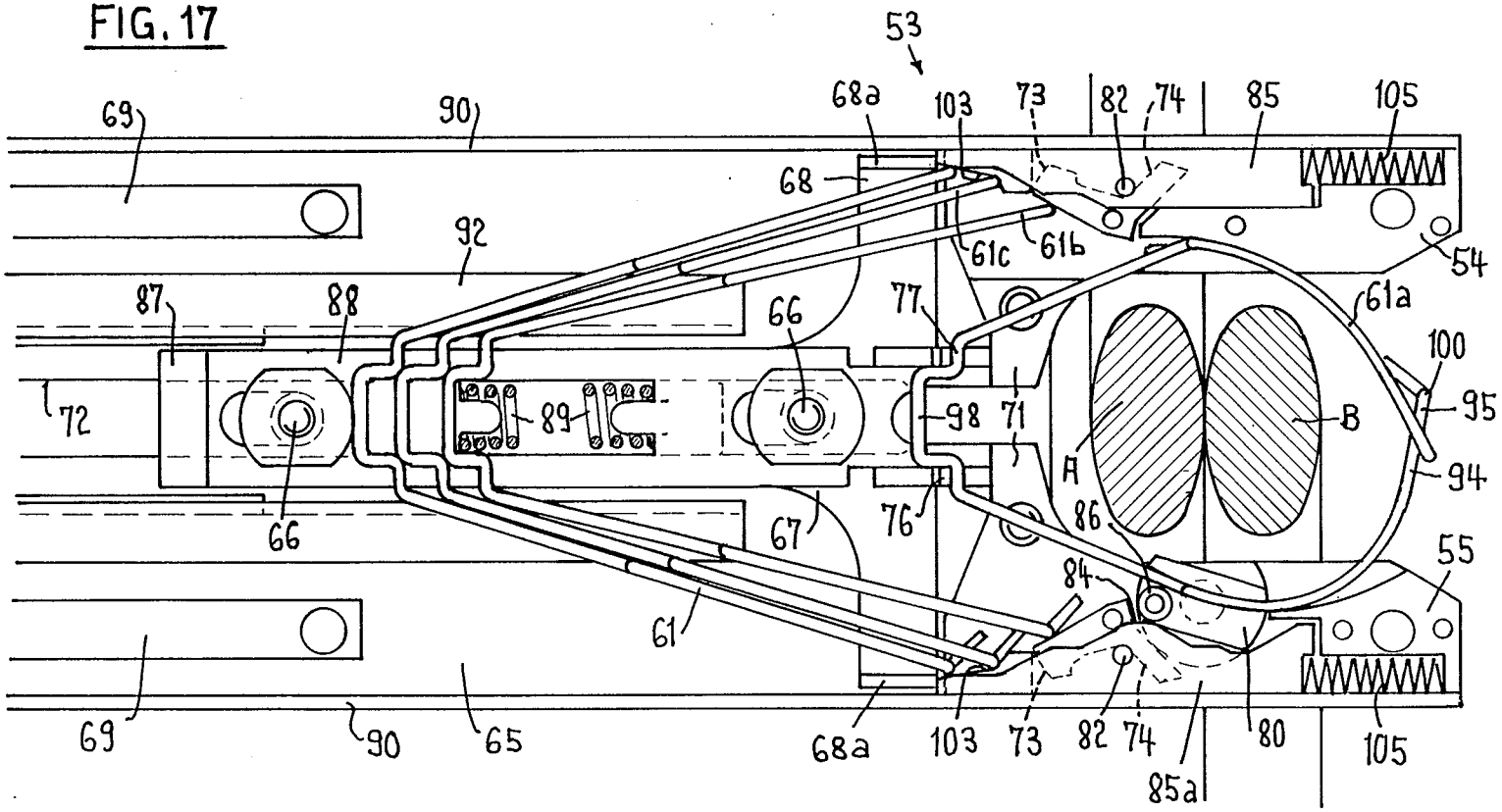
Figure 18:
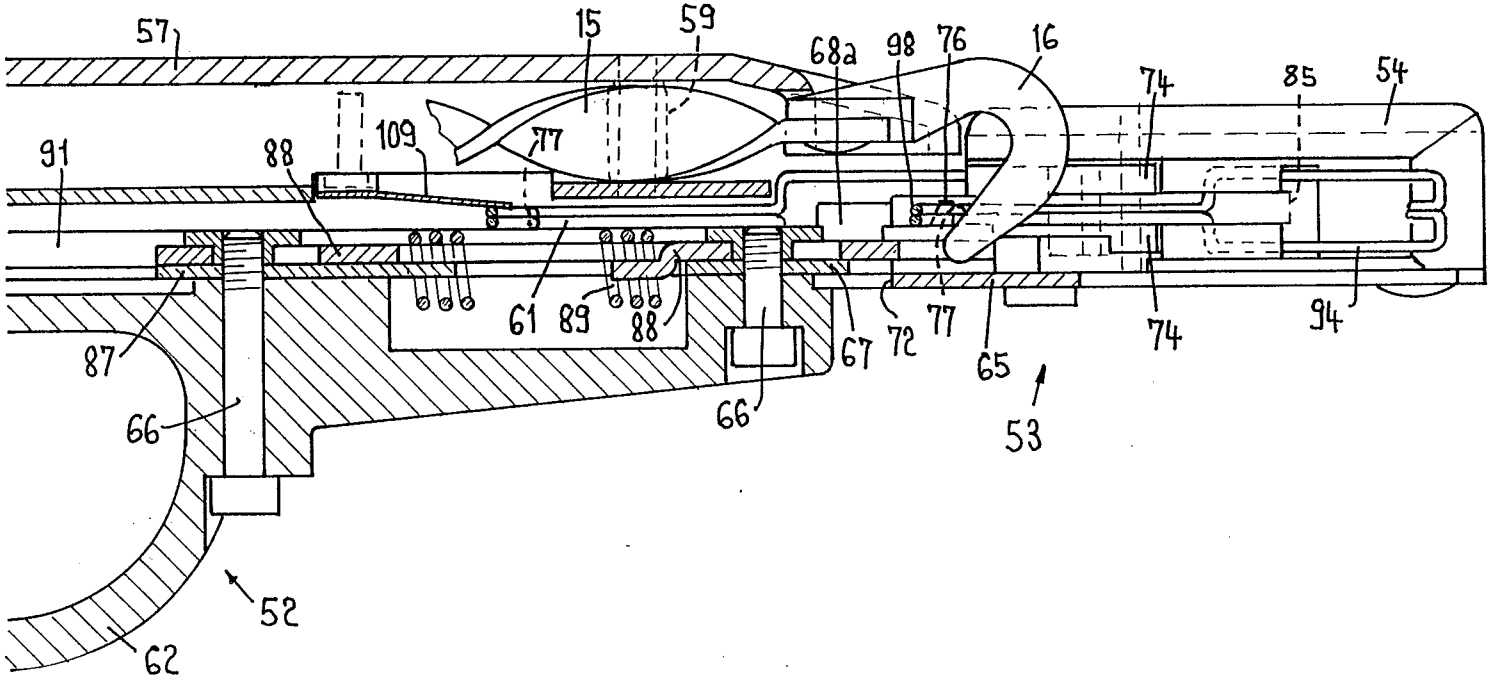
Figure 19:
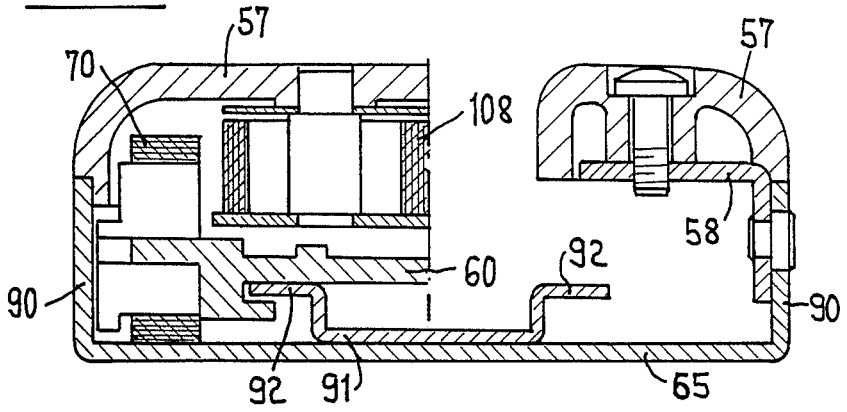

FIGS. 15 to 17 show three different phases of the closing procedure of the third embodiment;

FIG. 18 is a longitudinal sectional view of FIG. 16;

FIG. 19 is a sectional view taken along the line XIX—XIX of FIG. 13*a;*

Figure 20:
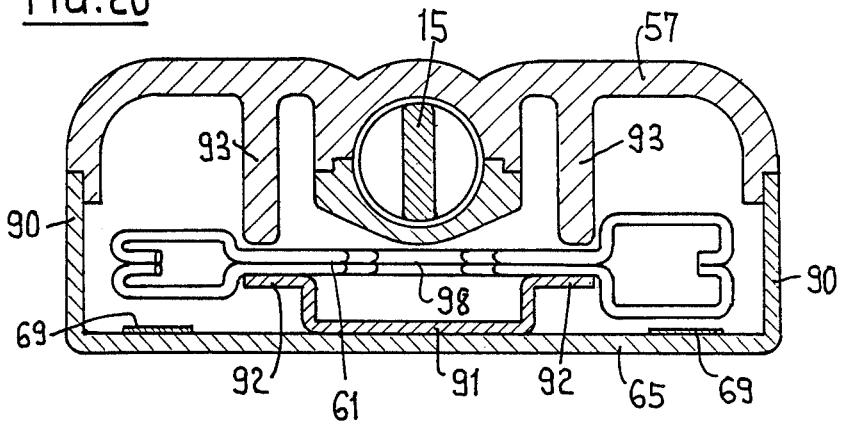

FIG. 20 is a sectional view taken along the line XX—XX of FIG. 13*a;*

Figure 21:
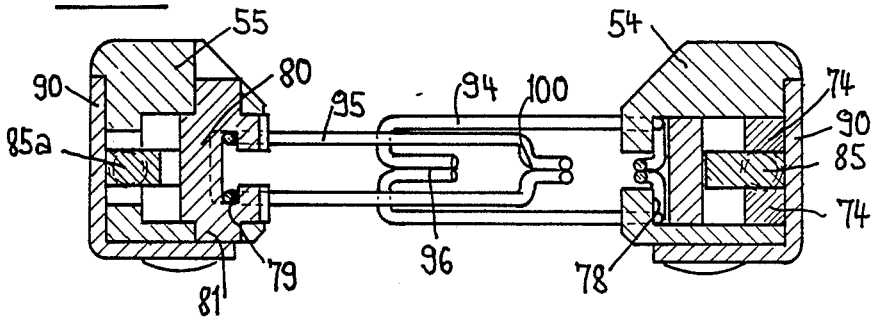
Figure 22:
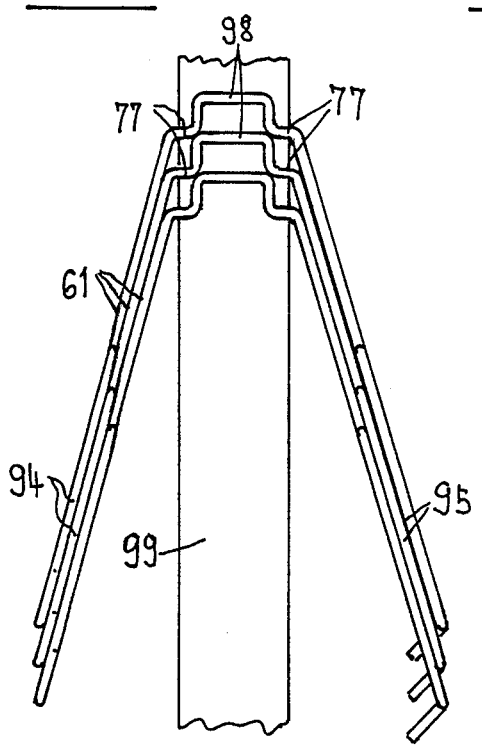
Figure 23:
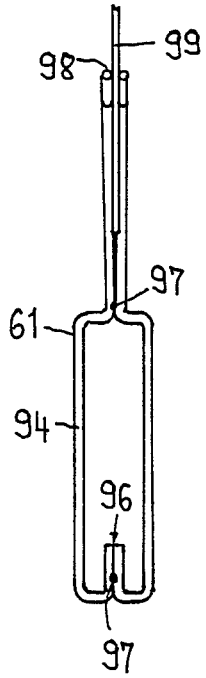
Figure 24:
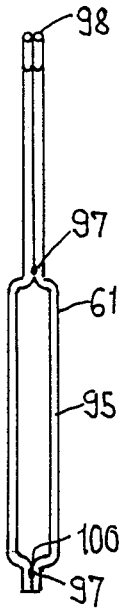
Figure 25:
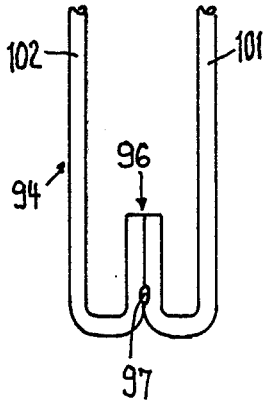
Figure 26:
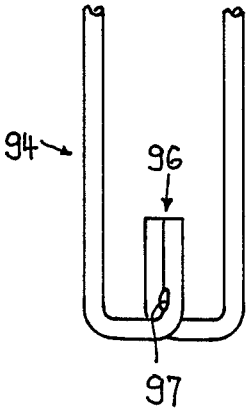
Figure 27:
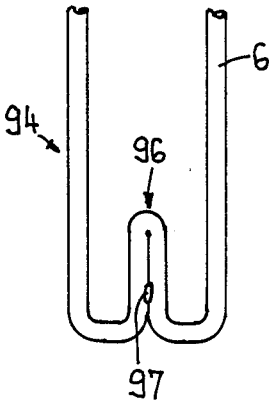

FIG. 21 is a sectional view taken along the line XXI—XXI of FIG. 16;

FIG. 22 is a plan view of wire clamps according to an additional embodiment which are attached to a strip;

FIGS. 23 and 24 are sectional views of a wire clamp of FIG. 22, viewed from both sides; and FIGS. 25 to 27 show three production examples of a wire clamp of FIG. 22.

Figure 10:
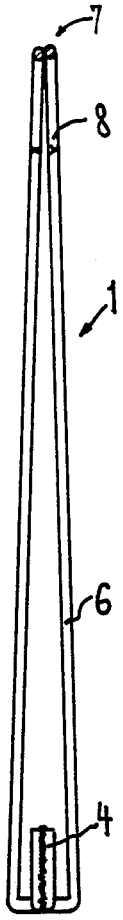
FIGS. 9 to 12 show a wire clamp of the invention from different sides and in two different working positions.
Figure 9:
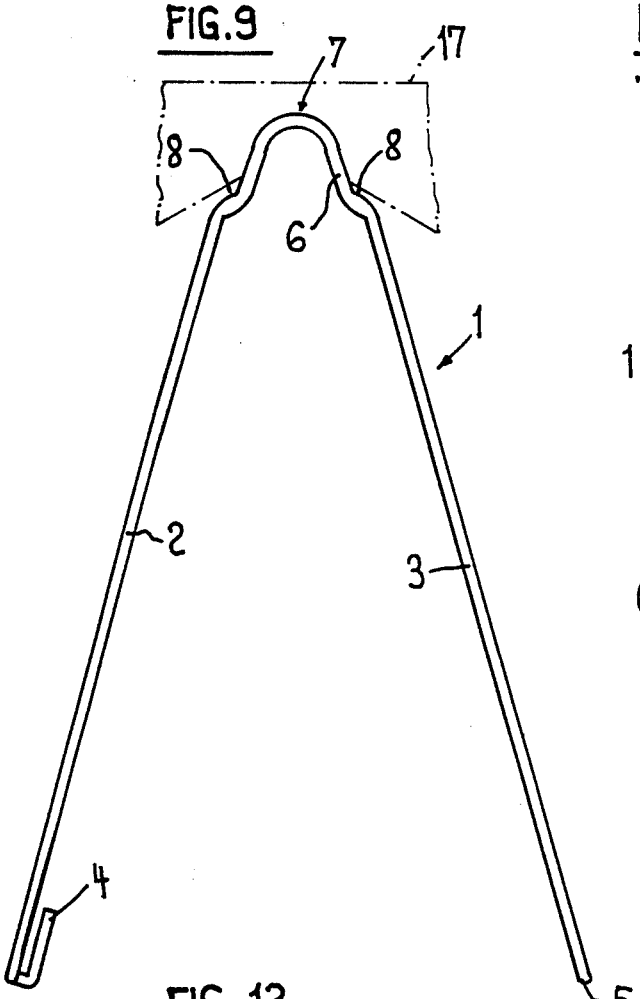
Figure 11:
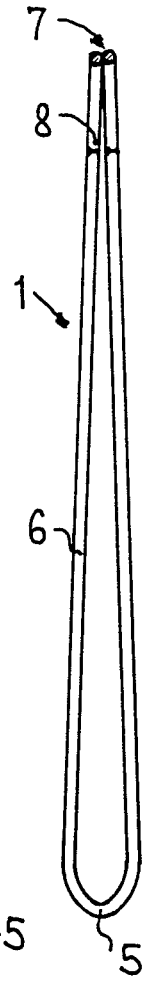
Figure 12:
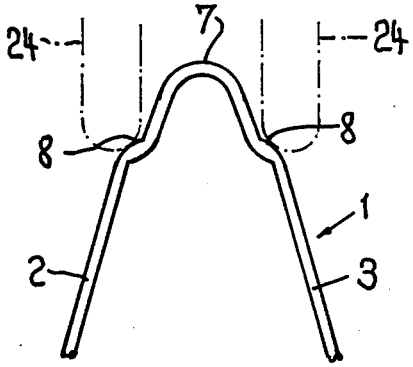

Instead of using two separate wire loops which each have two eyelets, the method of the invention utilises a wire clamp or clip 1 (shown in FIGS. 9 to 12) which is closed upon itself and is V-shaped when viewed from the side (see FIG. 9). At their lower ends, the two leg portions 2 and 3 are provided with locking means which, in the present example, comprises a hook member 4 on the leg portion 2 and a loop 5 on the other leg portion 3. As can be seen from FIG. 10 in particular, the hook member 4 is formed from the two welded end sections of the leg portions and is bent out of the plane of the leg portions. As can be seen from FIGS. 9 to 12 and from the description of these Figures, the single wire 6 is also doubled-over here to permit, on the one hand, a suitable flexibility and, on the other hand, an adequate tensile strength to be achieved. However, in the case of the hook member 4, the wire is only welded at one point, thereby simplifying the production of a clamp for a connection point. The transitional point 7 between the two leg portions is rounded at the apex and has a shoulder 8 on each side, the significance of this shoulder 8 being explained hereinafter in connection with the binding apparataus. The wire clamp may be produced from any suitable material, such as has been used in the past, but the usual requirements regarding deformability, weldability and tensile strength have to be met.

Figure 1:
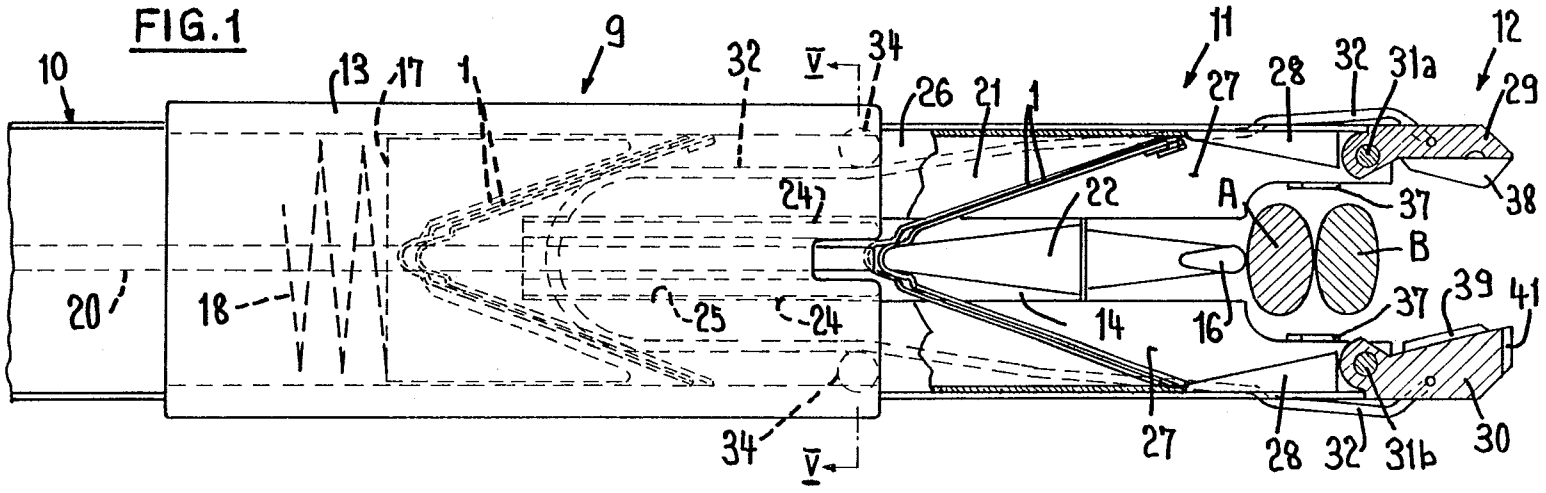
FIG. 1 is a top view of a partially cutaway portion of a first embodiment of the device according to the invention.
Figure 2:
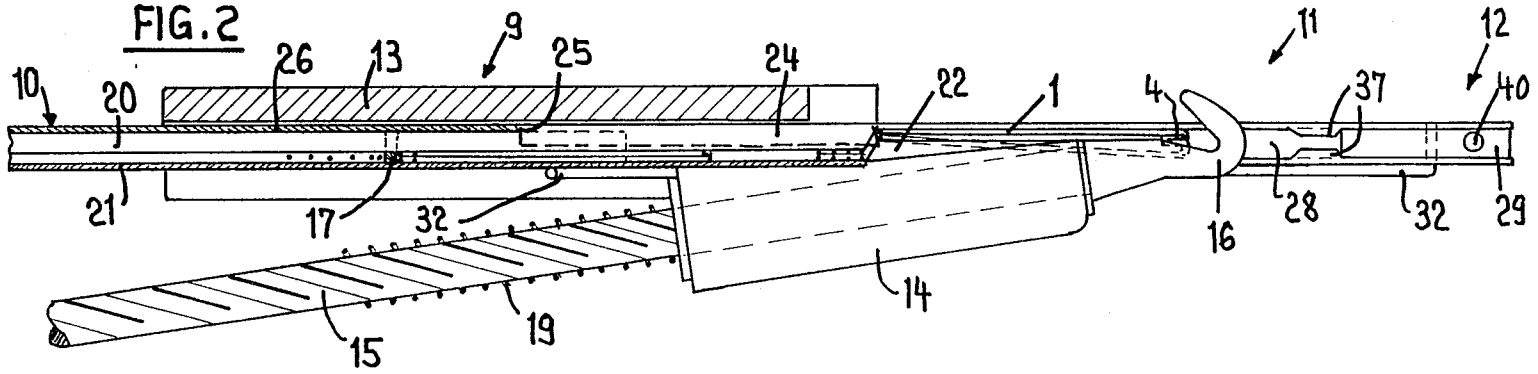
FIG. 2 is a longitudinal sectional view of the device of FIG. 1.

In contrast to all other known methods, the wire clamp, as shown in FIG. 9 is now brought from above over the steel rods, which are to be connected (see also FIG. 1). Subsequently, the lower ends of the two leg portions are interconnected by the locking means 4 and 5, whereupon the hook member of the binding apparatus seizes the transitional point 7 of the wire clamp and twists the upper portion of the clamp. Because the connection is effected from above, and because the wire clamp no longer needs to be manually inserted underneath the steel rods, the work is considerably facilitated, since the operator no longer needs to bend down to such a low level. Two embodiments of a device are described hereinafter, which device permits the locking means of the wire clamp to become engaged without the need for the operator to take the wire clamps into his hand, with the result that the connection is effected by a single moving operation of the device.

Consequently, the most important object of the device is to bring the locking means of the clamp into engagement beneath the rods to be connected and subsequently to seize and twist the transitional portion at the top of the wire clamp, all this being achieved in one working operation.

The device for accomplishing the method mainly includes a binding apparatus 9 and the wire clamps 1 which may possibly be disposed on a support means. The binding apparatus 9 is provided with a rectangular, hollow housing 10 which, in a preferred embodiment, serves also as a magazine for the wire clamps 1. The front end of the housing 10 entends into a locking portion 11 provided with closing jaws 12. The ends of the leg portions of the wire clamps 1 are provided with locking means and are bent by the closing jaws 12 in such a manner that the locking means engage with one another. The displaceable gripping member 13 is disposed around the housing so as to be slidable thereon and serves to seize the foremost wire clamp from the magazine and move it forwardly, i.e. downwardly. A guide bush 14 is mounted on the front portion of the housing, and a knurled rod 15, which is provided with a binding hook 16 is disposed in the guide bush 14 in such a manner that the knurled rod 15 is set in rotation when a relative movement occurs between the guide bush 14 and the knurled rod 15. A slide member 17 is also provided in the front portion of the guide housing and is advanced by the pressure of a spring 18 in order to push the wire clamps 1 forwardly and to bring the foremost clamp of the wire clamps into a position from which this clamp can be advanced by the gripping member 13. A compression spring 19 is provided on the knurled rod 15 and pushes the guide bush 14 back into its initial position after the binding process has been completed.

Figure 5:
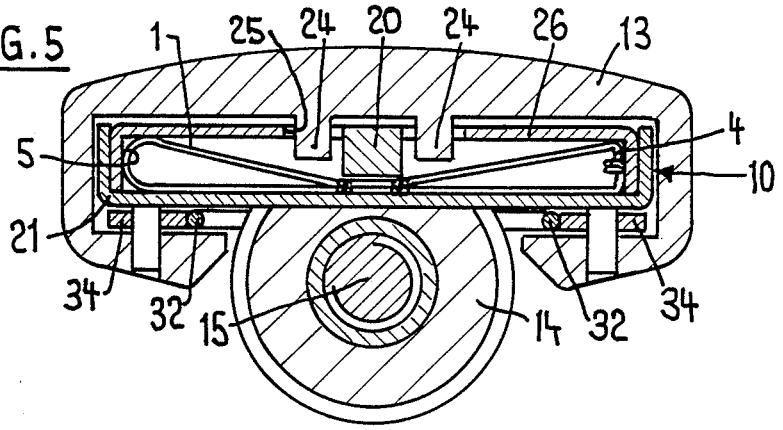
FIG. 5 is a sectional view, on an enlarged scale, taken along the line V—V of FIG. 1.
Figure 6:
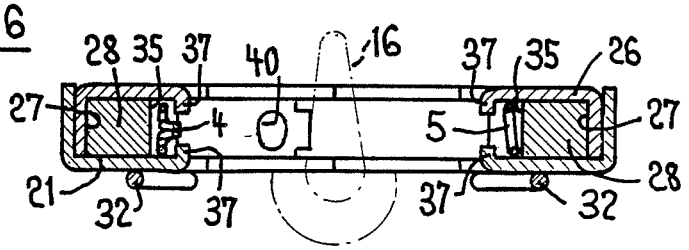
FIG. 6 is a sectional view taken along the line VI—VI of FIG. 3.

As can be seen from FIG. 5 in particular, the housing 10 is formed from two telescoped, U-shaped housing portions which accommodate the wire clamps 1. The wire clamps are held-down in the centre by a bar 20 so that the clamps cannot slide over one another. As can be seen from FIGS. 1 or 3, the lower plate 21 of the hosing is bent in a U-shape manner and is split from the front to the binding hook 16, the plate 21 extending into a projection member 22 (see FIG. 4 in particular) which has an inclined front end 23 abutting against the foremost wire clamp. According to FIG. 5, a slide bar 24 is attached to the underside of the gripping member 13, on each side of the held-down bar 20, and it slides into a slot 25 in the U-shaped upper portion 26 of the housing 10. The end of the slot 25 also serves as a stop means for preventing the possibility of the displaceable gripping member 13 being pulled further back. As can be seen from FIGS. 3 and 12, the slide bars 24 engage in the shoulders 8 of the wire clamp in order to advance the clamp. The result of this is that the cooperation between the hold-down bar 20 and the slide bars 24 and the projection member 22 permits only one wire clamp at a time to be seized in succession and prevents individual wire clamps from sliding over one another.

In the closing section of the housing, the lower housing portion 21 and the upper housing portion 26 each form a respective passage 27 on both sides, wedge-shaped guide members 28 being disposed in the passage 27 and having a triangular configuration, when viewed from above. As can be seen from the various positions of the leg portions of the wire clamp in FIG. 3, when the wire clamps are inserted through the displaceable gripping member, the wedge-shaped guide members cause the leg portions to be drawn together until they are brought fully into their closed position by the closing jaws.

Figures 3, 4:
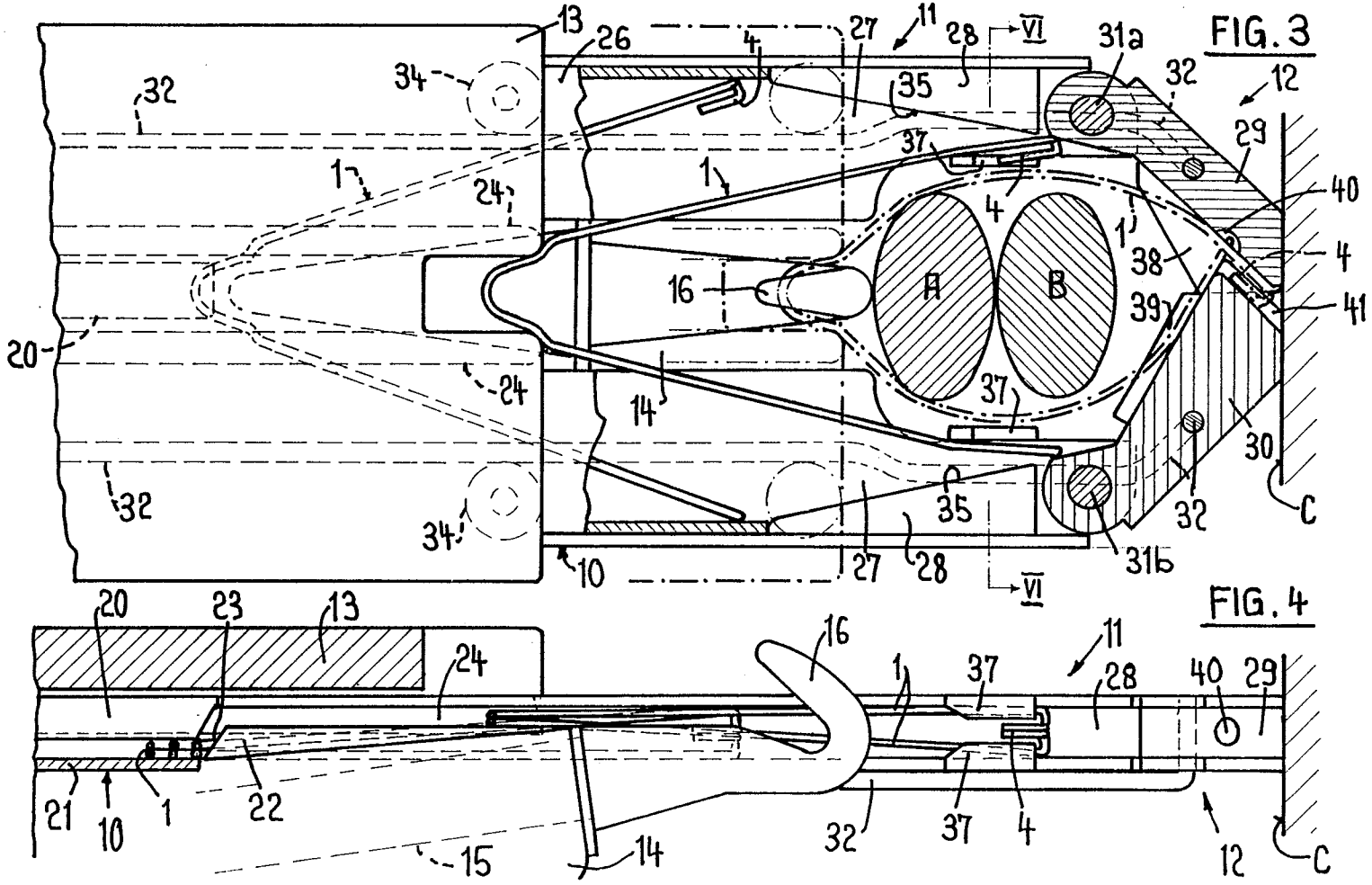
FIG. 3 shows an enlarged detail of FIG. 1.
FIG. 4 is a longitudinal sectional view of the enlarged detail of FIG. 3.

In the first embodiment, the wire clamps is deformed by displaceable clsoing jaws in order to bring its locking means into engagement. In FIG. 1, the apparatus is shown in its open position and, in FIG. 3, the apparatus is shown in its closed position. A first, displaceable closing jaw 29 is shown which is rotatable about a rotatable axle 31*a*, and a second, displaceable closing jaw 30 is shown which is rotatable about a rotatable axle 31*b*. The two closing jaws are actuated by a U-shaped closing spring 32, and the ends of the spring act on the closing jaws. As indicated in FIGS. 1, 3 and 5, two rollers 34 are provided on the displaceable gripping member 13 and act on the closing spring. As also follows from these Figures, during the forward movement of the displaceable gripping member, the rollers 34 cause the spring 32 to be compressed, and the two closing jaws also become compressed by this movement. As can be seen from FIG. 3, the ends of the wire clamps during the closing movement initially slide along the inclined face 35 of the wedge-shaped guide members 28 and subsequently pass behind the cams 37. From there, the ends pass over the bearing surface 38 on the upper closing jaw (shown in the drawing) and onto the bearing surface 39 on the lower closing jaw.

Figure 7:
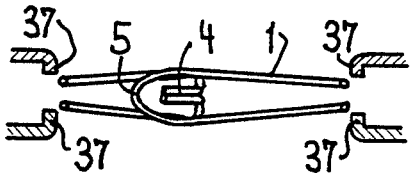
FIG. 7 shows a phase during the connecting operation.

The two closing jaws have different forms since the two ends of the wire clamp do not effect the same movement. Thus, the end of the wire clamp provided with the loop 5 is bent more intensely than the other end, which is provided with the locking hook 4. In the upper closing jaw 29 there is a recess 40 which accommodates the loop end of the wire clamp. The end 41 of the other closing jaw 30 is milled in order to accommodate the end of the wire clamp which is provided with the locking hook 4, as can be seen in FIG. 3. FIG. 7 shows the wire clamp in its end position, and it can be seen that the loop is placed over the locking hook in such a manner that the loop engages behind the hook during a withdrawal movement. It can also be seen from FIG. 7 that, in the end position, each end of the wire clamp slides out of the passage formed by the lower U-shpaed plate 21 and cams 37 since, in this position, the wire clamp has the thinnest point when viewed from the side.

The following working operation results from the description and from FIGS. 1 to 7: During the advancement of the binding apparatus over a point of intersection between two rods A and B which are to be connected, the binding apparatus abuts either with the closing jaws against the base C or with the locking hook against the upper rod A. With further advancing movement, the displaceable gripping member 13 is pushed forwardly. Consequently, as shown in FIG. 3, the wire clamp is forced into the closing jaws. At the same time, the clsing jaws are closed, so that the locking loop 5 is placed over the locking hook 4. During a pull-back movement, the locking loop is initially locked with the locking hook on the wire clamp, and the entire binding apparatus is pulled-back. Since the binding hook is in engagement with the wire clamp and the locked clamp abuts against the rod 8 during the pull-back movement, the binding hook is set in rotation by the upward movement of the guide bush, and the upper end of the wire clamp becomes twisted at the transitional point. Now it is only necessary for the binding hook to be pulled out of the eyelet formed after the twisting movement, and the connection is thus achieved.

Figure 8:
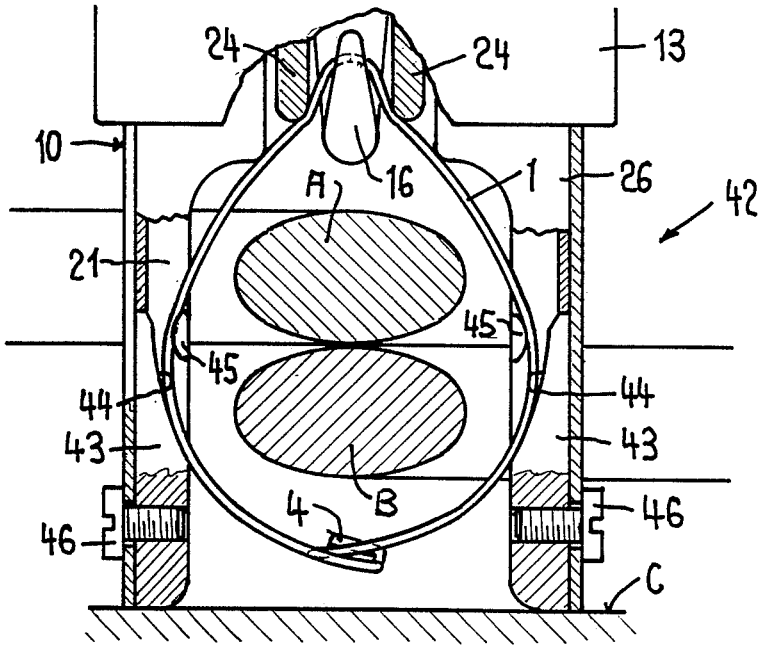
FIG. 8 is a top view of an enlarged detail of a second embodiment of the invention.

According to a second embodiment shown in FIG. 8, the closing means and the guide jaws can be considerably simplified. With the exception of the locking member, the apparatus with its displaceable gripping member is identical to the one described above. Contrary to the first embodiment, the locking member 42 does not contain any displaceable closing jaws, but only contains two rigid closing jaws 43 which may be operated in an indentical manner. The rigid clsoing jaws 43 have an arcuate closing edge 44 by which the two ends of the wire clamp are guided towards each other in order to come into the closed position shown in FIG. 7. In addition, each end of the wire clamp is directed onto this closing edge at a suitable angle by means of a cam 45 which is disposed opposite the closing edge, this cam having a guide face which is roughly semicircular. The function of this locking member is the same as in the first embodiment, but this locking member has the advantage of having no displaceable component part.

The closing jaws 43 are subject to considerable wear and, in order to permit them to be replaced easily, they are secured tot he lower hosing portion 21 by means of screws 46.

It follows from the description that this new apparatus permits two rods to be interconnected in a forward and backward movement without the need for bending-down for reinforcement rods on the ground. Since the entire working operation only consists of pushing and pulling movements, it is also possible for less skilled persons to be used for this work. Within the scope of the present invention, it is possible for various details to be changed. Thus, for example, it is possible to provide the magazine component is such a manner that wire clamps attached to a suitable carrier such as cardboard or plastic, can be inserted into the apparatus. In addition, it is possible for the magazine containing the wire clamps to be disposed laterally on the housing of the binding apparatus, i.e. at right angles to the closing movement, whereby the apparatus has a suitable aperture and the side member, which advances the individual wire clamps, is adapted accordingly.

It is also possible to alter the locking means on the wire clamp, i.e. to dispose the locking hook and the locking loop in a different plane. With reference to FIG. 9, this means that the locking hook 4 projects, either upwardly or downwardly, from the plane formed by the leg portions which are disposed in a V-shaped manner, and that the loop-like end of the leg portion 3 is bent accordingly. Instead of being formed from a wire, the clamps may also be formed from pieces of sheet metal strips.

For further, simplified work, it is possible to effect twisting by a battery-powered drive means instead of by pulling the apparatus, and such drive means permits work to be carried out more rapidly in an energy-saving manner.

FIGS. 13*a* to 27 illustrate an additional, preferred arrangement, which is similar to the device of the second embodiment, with fixed jaws and provides a further improvement in respect of the wire clamps being securely hooked in pposition, their being separated and positively inserted into the closing device. As will be described in more detail hereinafter, this improvement is achieved because a displaceable member in the closing region causes, on the one hand, the wire clamp to be brought into a secure closed position and provides, on the other hand, a positive separation of the wire clamps in order to bring them positively into the correct initial position.

As can be seen from FIGS. 14*a*, 14*b* and 18 in particular, the knurled rod 15 with the binding hook 16 extends parallel to the housing 50 of the binding apparatus 51 and, hence, parallel to the gripping member 52 also, thereby pemitting a particularly compact and sapce-saving arrangement to be achieved. At its front end, the hosing 50 extends into a locking member 53 which includes two rigid closing jaws 54 and 55. The rear of the knurled rod 15 is rotatably mounted and secured in a resilient bearing 56. The bearing 56 is connected, by means of resilient connectins 107, to two springs 108 in spring housings which are connected to the gripping member. FIG. 14*a* also shows the cover 57 which is pivotally mounted at its rear, i.e. on the left of the drawing, on a bearing 58. A guide bush 59 comprises two rollers and is disposed in the front region of the housing (see FIG. 18). The knurled rod with the binding hook can be set in rotation by means of the guide bush 59. FIG. 13*a* shows a clamp slide 60 which is actuated by the spring strips 69 and pushes the wire clamps 61 in a forwardly direction, the springs running along the spring rollers 70.

The rear end of the gripping member 52 with the handle 62 is connected to the housing base 65 by means of an expansion bolt 63 which slides in a slot 64 in the housing base 65. The gripping member 52 is additionally provided with a rod guide 106 which may be used to keep the apparatus upright with the aid of an extension rod, if connections are to be formed on the base. The front end of the gripping member is connected by two screw bolts 66 to a T-shaped member 67, which slides in the lower hosing portion and has a multiple function; the screw bolts sliding in a longitudinal slot 72 in the hosing base 65. A slide member 88 is connected to the T-shaped memeber via a spring 89 and is slidably disposed above the longitudinal leg portion 87 of the T-shaped member; the front portion of the slide member 88 being provided with two projection members 76, which engage in two shoulders 77 in each particular foremost wire clamp 61*a*.

The closing movement is now described with reference to FIGS. 15, 16 and 17, and the multiple functions of the T-shaped member and of the compopnent parts which are displaced by this T-shaped member are also explained. In FIG. 15 the apparatus is shown in its initial position, the foremost wire clamp 61*a* having been brought into this initial position by means of a loading movement. The foremost wire clamp 61*a* is pressureless in the apparatus, and the pressure which is exerted by the clamp slide 60 is absorbed by the wire clamp 61*b* situated therebehind, the two ends of the wire clamp 61*b* abutting against a shoulder 73 of a pawl 74 provided with pivot 75. During the forward movement of the handle 52, the T-shaped member 67 which is connected thereto is also moved forwardly until it is in the position shown in FIG. 16. In this position, the projection members 76 on the slide member 88 engage with the shoulders 77 of the foremost wire clamp 61*a* and the front of the slide member abuts against the stop members 71 of the two closing jaws. The locking members of the wire clamp thereby pass into the respective guide passages 78 and 79 (see FIG. 16); they are bent in accordance with the respective guide passage and brought into their closed position. Whereas the guide passage 78—the upper passage in the drawing—is a milled portion in the upper closing jaw 54, the other guide passage 79 is situated in a rotatable member 80 which is mounted so as to be rotatable about a journal 81.

During the subsequent forward movement, during the transfer to the position shown in FIG. 17, only the T-shaped member 67 is still moved forwardly in opposition to the pressure of the spring 89, the short leg portions 68 of the T-shaped member 67 actuating two cam slides 85 and 85*a* which are disposed in the closing jaws and are each actuated by a spring 105. Each of the two cam slides is provided with a pawl pin 82 for actuating the pawls 74, whereas one of the two cam slides—85*a*—additionally has a shoulder 84 which acts on a pin 86 on the rotatable member 80 in order to rotate the rotatable member 80. Fixed cam members having a recessed portion 103 are subsequently moulded on the cam slides, and the third wire clamp 61*c* (see FIG. 17) engages in said cam members at the very moment when the second clamp 61*b* becomes free. Rotation of the rotatable member induces that portion of the wire clamp which is situated in the guide passage 79 to be rotated outwardly in order to bring the licking means of the wire clamp into secure engagement.

Upon withdrawal of the gripping member, the pawls 74 are brought into their initial position and the wire clamp 61*c* abuts against the shoulder 73 of the pawl, whereas the wire clamp 61*b*—which is now foremost—is pressureless and can be pushed into the guide passages. For this purpose, however, the wire clamp 61*b* must previously be raised from the appropriately shaped projection members 76 on the slide member. So that the foremost wire clamp securely abuts against the projection members after this operation, this wire clamp is pressed downwardly by means of a spring 109 (see FIG. 18).

At the same time, the transitional portion 98 is situated between the two leg portions of the wire clamp in the binding hook which, upon withdrawal of the binding apparatus, is set in rotation by the guide bush and twists the wire clamp. After the twisting operation, only the binding hook still needs to be removed from the eyelet formed after twisting, and the desired connection is achieved.

It can be seen from FIGS. 19 to 21 that the housing 50 has a U-shaped lower portion comprising the housing base 65 and the two lateral walls 90, and that a guide means 91 is disposed ont he housing base and is also U-shaped with horizontal leg portions 92 attached thereto. This guide means has a dual role to play: first of all it serves as a means for guiding the wire clamps 61, and then it serves as a means for guiding the clamp slide 60. In addition, the cover 57 is provided with two guide bars 93 for holding-down and guiding the wire clamps.

Compared with the wire clamp 1, the wire clamp 61*a* has a more angular form the shoulder 77 in particular being distinctive and roughly rectangular in order to ensure that the cams 76 engage securely on the slide member 88. One locking leg portion 94 is wider than the other leg portion 95, and the hook member 96 in this embodiment is in the same plane as the existing locking leg portion 94. In the present example, the wire clamp comprises two wires 101 and 102 which are welded together at four points 97. The two wires are open at the transitional portion 98 between the two locking leg portions in order to accommodate the plastics strip 99 therebetween. The plastics strip is merely a packing and conveying strip. The strip is removed once it has been charged with the wire clamps and loaded into the machine.

In the closed position shown in FIG. 17, it can be seen that the narrower locking leg portion 95 engages in the wider locking leg portion 94, and the lower locking loop 100 of the narrower locking leg portion grips behind the hook member 96. The wire clamps may be welded, as in FIG. 25 or 26, or they may be formed from a single wire 6, as in FIG. 27. As mentioned in the preceding examples, however, it is also possible to produce the clamps from a place of sheet metal strip instead of from wire.

In the preferred modification, it is also possible to effect twisting by a battery-powered drive means instead of by pulling the apparatus. For the sake of simplicity, a binding hook has been used in the embodiments which have been described hitherto, but it is also possible to provide a grabbing mechanism instead.

We claim:

1. A method for binding at least two rods, comprising the steps of:

providing a binding apparatus having a rotatable grabbing means;

providing a wire clamp having a pair of leg portion ends provided with complementary locking means;

positioning said wire clamp around the rods from a first side thereof whereby said leg portion ends extend to a second opposite side of said rods;

engaging said complementary locking means on said second side;

grasping said wire clamp from said first side with said grabbing means rotating said grabbing means to thereby twist said wire clamp and bind said rods.

2. A method as claimed in claim 1, wherein the binding apparatus includes two closing jaws, the method further including:

positioning said binding apparatus on said first side of said rods;

bending said leg portion ends of the wire clamp towards each other in order to bring the complementary locking means on the wire clamp into engagement by means of said closing jaws thereafter performing the step of;

rotating said grabbing means.

3. A device for binding a pair of rods, comprising:

a housing;

a displaceable dispensing means attached to said housing for the forward conveyance of a wire clamp having a pair of leg members provided with complementary locking means, said dispensing means being disposed on a first side of said rods;

closing jaws pivotly attached to said housing; said closing jaws being adapted to being the complementary locking means on the wire clamp leg members into engagement on a second, opposite side of the rods, and grabbing means disposed on said first side of the rods for subsequently twisting the wire clamp to thereby bind said rods together.

4. A device as claimed in claim 3, including:

a first one of said closing jaws having a rigid guide passage and a second one of said closing jaws having a displaceable guide passage, wherein:

said first jaw is configured for receipt of a first one of said leg members; and said second jaw is configured for receipt of a second one of said leg members in such a manner that, during the closing movement the leg portion situated in said displaceable guide passage is moved away from the other leg portion by said second jaw in order to effect a secure engagement of the complementary locking means.

5. A device as claimed in claim 4, wherein the displaceable guide passage includes a rotatable member and a journal on which the rotatable member is rotated during the forward movement of the grabbing means.

6. A device as claimed in claim 3, wherein the grabbing means is connected to a T-shaped member which slides in the housing, said grabbing means including a slide member which is displaceable relative to the T-shaped member by the pressure of a spring, said device further comprising:

a plurality of clamps disposed within said housing, the slide member having two projection members, for engagement with a first one of said clamps in order to move the first clamp into operative position about said rods; and cam means for activating said closing jaws in response the said clamp positioning.

7. A device as claimed in claim 6, further including pawl means for blocking the advancing movement of a second wire clamp.

8. A device as claimed in claim 3, wherein said housing comprises a U-shaped base portion a pivotally mounted cover two guide bars for securing said cover to said base, and a U-shaped guide means with two horizontal leg portions for guiding the wire clamps.

9. A device as claimed in claim 8, further including a clamp side biased by two spring strips for advancing said clamps.

10. A device as claimed in claim 3, wherein each of the closing jaws are rigid and have an arcuate closing edge, the device including a guide cam disposed opposite each closing edge in order to guide the ends of the wire clamp onto the closing edges.

11. A device as claimed in claim 10 wherein the housing is hollow, and comprises upper and lower housing portions the upper housing portion facing the dispensing means and being provided internally with a hold down bar, dispensing means being provided internally with a slide bar on each side of said hold-down bar, the slide bars extending in a slot in the upper housing portion whereby wire clamps are successively urged forward upon actuation of the dispensing means, the lower housing portion having a upwardly protruding extension member which cooperates with the hold-down bar to prevent the wire clamps from sliding over one another.

12. A device as claimed in claim 11, wherein the two housing portions are split in the locking member and are each adapted to form an internally open passage for the wire clamps.

13. A device as claimed in claim 3, wherein the closing jaws are displaceable and are actuatable by a U-shaped closing spring, the leg portions of the closing spring being operable to urge said jaws in a closing movement and, further including a roller means on the underside of the displaceable griping member for separating said closing spring leg portions.

14. A device as claimed in claim 13, wherein said complementary locking means includes a loop member at an end of a first clamp leg and a hook member at an end of a second clamp leg; a first one of said displaceable closing jaws having a recess for accommodating the first clamp leg a second closing jaw having a milled portion for accommodating the second clamp leg.

15. A device as claimed in claim 13 further including laterally disposed deflection and guide means for guiding the wire clamp legs onto the closing jaws.

16. A device as claimed in claim 3 further including a guide bush mounted to said housing, said grabbing means further including a binding hook attached to a knurled rod slidingly disposed in the guide bush whereby said knurled rod is set in rotation by a relative movement between the guide bush and the knurled rod.

17. A device as claimed in claim 16, wherein the knurled rod is disposed in the housing and extends parallel to the housing base.

18. A device as claimed in claim 3, wherein the housing is a loadable magazine for the wire clamps and has a slide member which is subject to spring pressure.

19. A device as claimed in claim 3, wherein the guide bush is actuated by a compression spring.

20. A device as claimed in claim 3, wherein the wire clamps are disposed in a magazine which is insertable into the housing at right angles to the closing movement.

21. A device as claimed in claim 3, wherein the binding apparatus has a battery-powered drive means.

* * * * *